United States Patent [19]

Nakamura

[11] Patent Number: 4,942,705

[45] Date of Patent: Jul. 24, 1990

[54] WINDOW GRATING ARRANGEMENT

[75] Inventor: Takashi Nakamura, Amagasaki, Japan

[73] Assignee: Nakamura Co., Ltd., Hyogo, Japan

[21] Appl. No.: 384,738

[22] Filed: Jul. 24, 1989

[30] Foreign Application Priority Data

Oct. 3, 1988 [JP] Japan ..... 63-129737[U]
Jan. 27, 1989 [JP] Japan ..... 1-9035[U]

[51] Int. Cl.[5] ..... E06B 3/26

[52] U.S. Cl. ..... 52/202; 292/144; 292/302; 49/56; 52/106

[58] Field of Search ..... 52/202, 106, 456, 507, 52/509; 49/50, 51, 56; 292/33, 144, 302

[56] References Cited

U.S. PATENT DOCUMENTS 4,225,164 9/1980 Wensley et al. ..... 292/33
4,400,912 8/1983 Wicks, Sr. ..... 49/56 X
4,519,640 5/1985 Mombelli ..... 292/144 X
4,685,316 8/1987 Hicks et al. ..... 49/56 X
4,810,999 3/1989 Moshier ..... 49/50 X

*Primary Examiner*—David A. Scherbel
*Assistant Examiner*—Creighton Smith
*Attorney, Agent, or Firm*—Schweitzer & Cornman

[57] ABSTRACT

A window grating arrangement is placed across a window opening in a building wall to keep out burglars but can be removed from the window opening alongside the wall in a required time, especially so as to enable dwellers to flee in an emergency. The window grating arrangement is so constructed that a pair of parallel stationary supports are fixed on the surrounding portions of the window opening in the wall while a mobile assembly of protective bars are sustained slidably on the supports.

6 Claims, 11 Drawing Sheets

WINDOW GRATING ARRANGEMENT

FIELD OF THE INVENTION

The present invention relates to a window grating formed of an assembly of protective bars, which is placed across a window opening and fastened to the walls of a building, such as to keep out burglars.

BACKGROUND OF THE INVENTION

In general, a window grating of the above type is attached to predetermined parts of the wall surrounding the window opening to be firmly retained, so that there is concern that an accident occurs in an emergency of fire or the like, and also numerous accidents arose from such arrangement to date.

For the purpose of solving the problems of such conventional window gratings, there has previously been proposed an adapted window grating so constructed that one edge and the other edge are mounted pivotably and outwards turnably respectively on the corresponding window surrounding portions of the wall to enable fleeing through the window opening and the so opened grating. In addition, this known window grating is equipped at its turnable edge with a lock which is ordinarily fastened and opened with a key in case of an emergency as described above.

According to the above-mentioned known openable window grating, however, enough space is necessary for the pivoted edge to move outwardly. Such an open condition gives rise to difficulty in installation on window opening adjacent to a neighboring house, garden, trees or the like. Furthermore, such a lock as used with a key is a rather cumbersome one to open, so that there is an additional problem to open the locked wimdow grating easily and promptly.

SUMMARY OF THE INVENTION

According to the present invention there is provided a window grating arrangement comprising a pair of parallel stationary supports fixed on surrounding portions of a window opening in a house wall, and a mobile assembly of protective bars sustained slidably on said supports to cover the window opening.

The present invention aims at solving the above-mentioned drawbacks of known window gratings, and has as its primary objective to provide an improved window grating which can be moved to enable fleeing through a window opening in an emergency, and which can be installed in limited space for mobility in spite of any obstruction in the surrounding of the window.

Another object of the present invention is to provide a window grating that can be opened in an emergency from a closed condition easily and promptly by the use of an easy to operate locking device.

A further object of the present invention is to provide a window grating equipped with an automatic alarm system which can make an emergency known promptly when the window grating is displaced.

Other objects and advantages of the present invention will become apparent from the detailed description given below; it should be understood, however, that the detailed description and specific embodiment are given by way of illustration only.

BRIEF DESCRIPTION OF THE DRAWING

Various changes and modifications within the spirit and scope of the invention will become apparent to those skilled in the art from the following detailed description and drawing wherein:

FIGS. 15, 16, and 17 are side elevational views taken respectively along the lines 15—15, 16—16 and 17—17 of FIG. 14;

FIGS. 18 and 23 are a horizontal cross-sectional view, FIGS. 19 and 21 are each a side view taken along the line 20—20 of FIG. 18; FIGS. 25 and 28 are respectively a horizontal cross-sectional view, and FIGS. 26 and 28 are respectively side views taken along the line 26—26 of FIGS. 25 and the line 28—28 of FIG. 27.

DETAILED DESCRIPTION OF THE PREFERRED EMBODIMENTS

Figure 1:
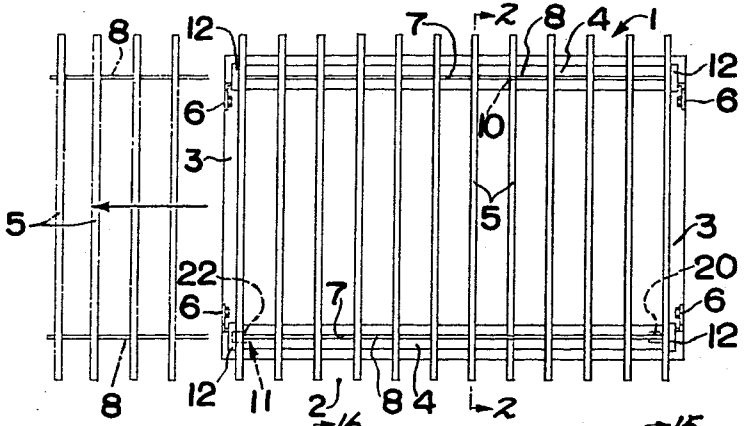
FIG. 1 is a front elevational view showing a window grating of the present invention which is placed across a window opening in the wall of a building.
Figure 14:
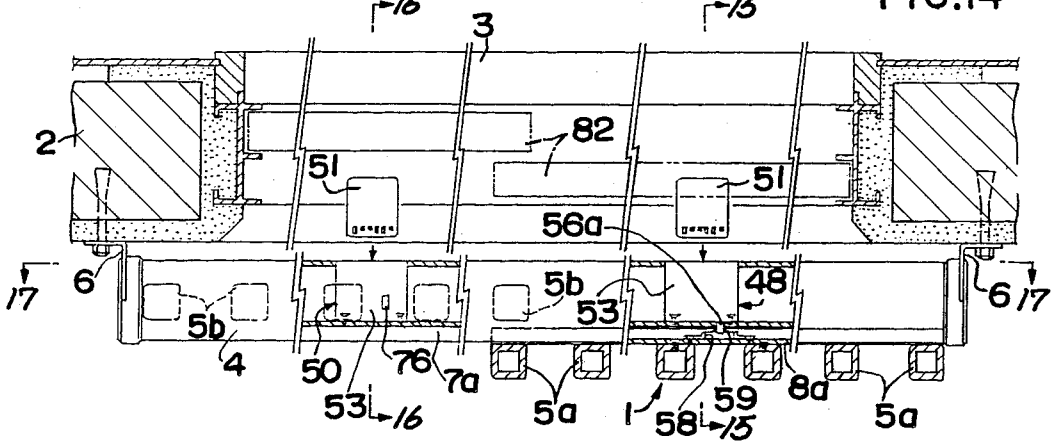
FIGS. 14–17 illustrate a second embodiment of a window grating according to the present invention: in particular.

As shown in FIG. 1, a window gratin, arrangement is formed from a mobile assembly 1 of protective upright rods 5, and a pair of upper and lower horizontal supports 4. The horizontal supports are attached to the surrounding portions of a window opening 3 in the wall of a house, for supporting the aforesaid mobile assembly 1 so that it is displaced in relation to the window opening 3. A locking device 10 is provided on either of supports 4 for fastening the mobili assembly 1.

Figure 2:
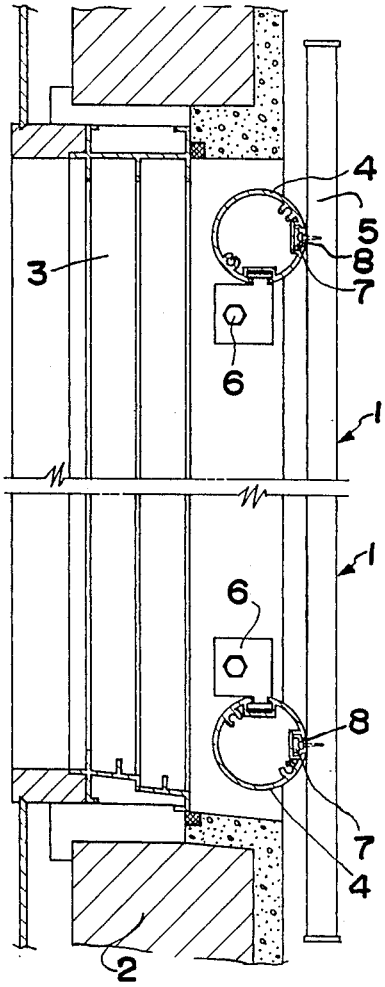
FIG. 2 is a cross-sectional side elevational view taken along the line 2—2 of FIG. 1.

The foregoing mobile assembly 1 is shown in greater detail in FIGS. 1 and 2, as having a large number of protective hollow rods 5, such as of extruded aluminum, which rods are arranged upright in parallel with each other. A pair of cylindrical horizontal cross ties 8 horizontally connect the rear parts of a number of protective rods 5. The upper and lower horizontal supports 4 are suitably extruded, hollow aluminum cylinders and are attached to the upper and lower parts of the surrounding window opening 3 in the wall by supporting fixtures 6. A longitudinal guide groove 7 is open to the outside and is suitably provided in the horizontal support 4, to enable the cross tie 8 of the mobile assembly 1 to fit into the groove and slide along it. Thus, the mobile assembly 1 of protective bars is supported movably in the horizontal direction by the horizontal supports 4 with the cross ties 8 fitted into the guide grooves 7, and thereby can be displaced smoothly from the window opening alongside the wall in order that people can flee in an emergency from the building without any hindrance.

Figure 3:
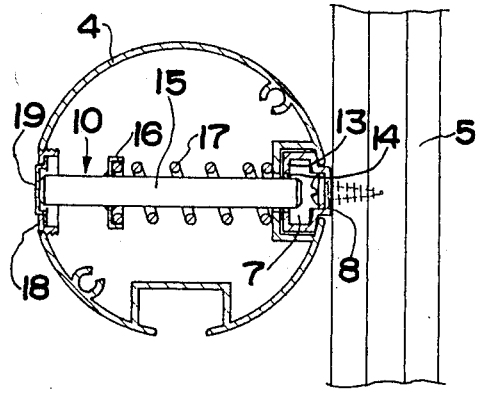
FIG. 3 is an enlarged, vertical cross-sectional view of the locking device in the window grating.

The locking device 10 is built into the upper horizontal support 4, as shown in FIG. 3, and has a locking bolt 15 for blocking the lateral movement of the mobile assembly 1 of protective rods 5, by fitting into a circular insertion slot 14 in a striking plate 13 integral with the cross tie 8 through an opening of the guide groove 7. A spring 17 which is disposed around the locking bolt 15 is maintained between the bottom of the guide groove 7 and a retaining ring 16 attached integrally to the locking bolt 15, and a restricting circular lid 18, for pressing the bolt 15 in the cylinder of the support 4. The bolt fits removably into an opening of the portion of the horizontal support 4, opposite to the guide groove 7. The restricting lid 18 has a replaceable rigid plastic cap 19 therein.

The locking device 10 normally operates by the locking bolt 15 fitting into the insertion slot 14 of the cross tie 8, whereas the locking device 10 is unlocked in an emergency so that the mobile assembly 1 can be caused to slide on the guide groove 7 of the horizontal support 4 the wall, by forcibly breaking the plastic cap 19 to slide out the bolt 15 from the slot 14 of the cross tie 8.

In addition to the locking device 10, the lower horizontal support 4 is provided with a built in automatic alarm systeem 11 for sounding an emergency alarm when the mobile assembly 1 of protective bars is displaced from before the window opening. As illustrate particularly in FIG. 4, the alarm system 11 is composed of a plate spring **20*a* having an outward projection bent into semi-circle in section at one end portion thereof, a limit switch 20 connecting with the other end of the plate spring 20, a buzzer of bell 22 adapted to be actuated by the limit switch, and a battery 23. The projected portion of the plate spring 20*a* is arranged so that it regularly ranges through an opening of the cylindrical support 4 and abuts against a contacting block 21. The circuit of the alarm system 11 is closed to operate the alarm buzzer 22, when the cross tie 8 of the mobile assembly 1 is caused to slide on the guide groove 7 of the lower support 4 and thereby the above-mentioned projection of the plate spring 20*a* no longer abust against the contacting block 21 of the cross tie 8, and thus moves outwardly into the position shown by a dot-dash line in FIG. 4. Conversely, the circuit is normally maintained open, i.e. switched off when the projection of the plate spring 20*a* is in contact with the block 21**.

Figure 5:
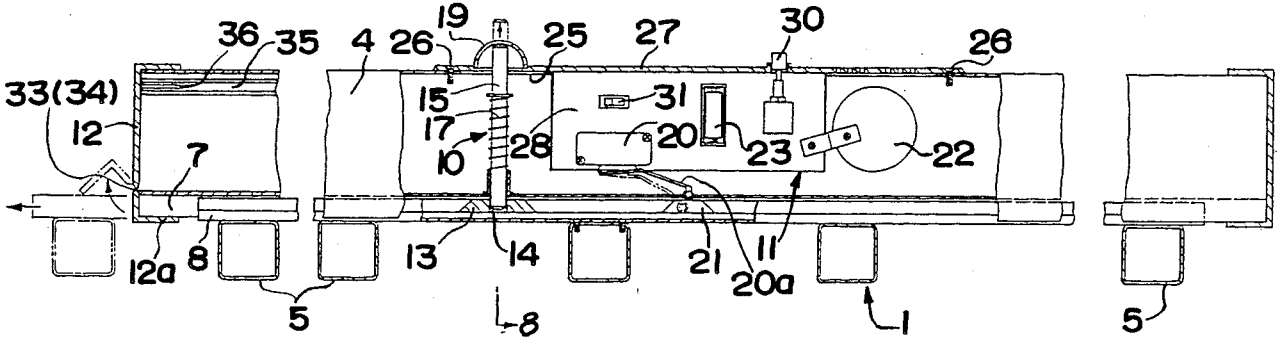
FIG. 5–8 inclusive illustrate an embodiment of the invention combining the locking device and alarm system of FIGS. 3–4.
Figure 6:
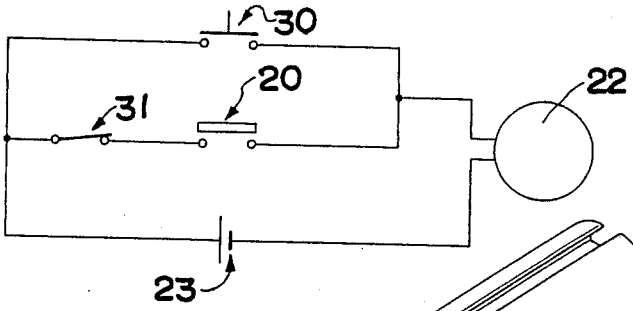
Figure 7:
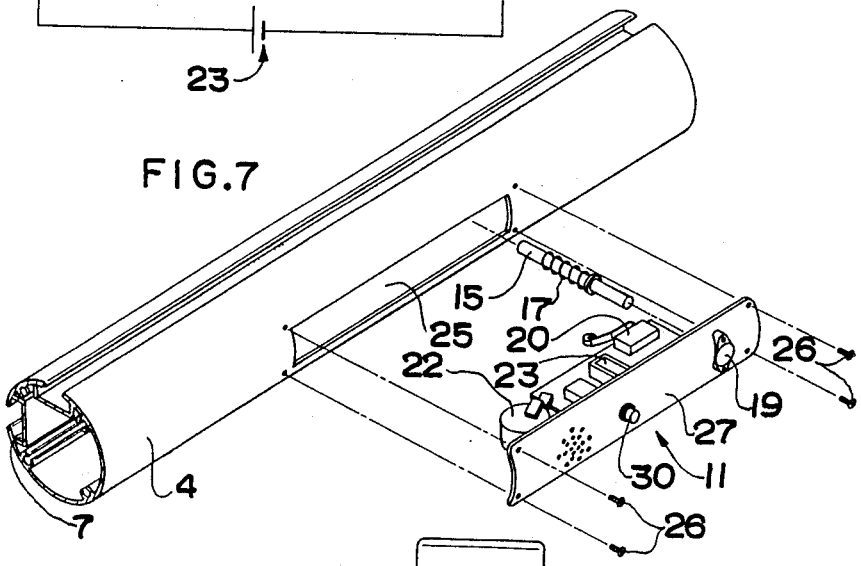
Figure 8:
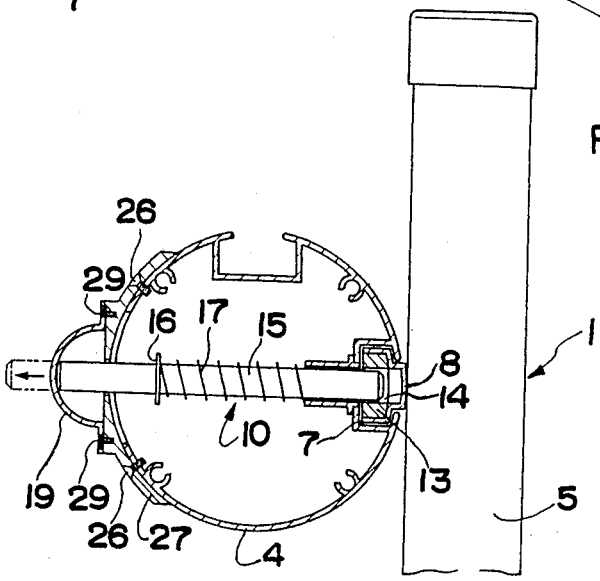

The locking device 10 as well as the alarm system 11 are individually constructed and installed in the separate upper and lower supports 4, respectively, but can also be used in the form of an incorporated construction as shown in FIGS. 5–8. This combined embodiment includes, in addition to the respective members described above, a pushbutton switch 30 for operating the buzzer 22 and a sliding switch 31 for optionally operating the limit switch 20, with the arrangement of controls on a cover plate 27 nd an insulating plate as shown in the drawings, with an electrical circuit as shown in FIG. 6 According to the embodiment of FIGS. 5–8, it is possible to make an emergency known promptly and also to test the operation of the alarm system with locking. Further it is possible to switch off apparatus when it is not required for any reason. In the combined embodiment, the plastic cap 19 of the restricting lid shown in FIG. 8 is shaped like a half-sphere and is fixed in a projecting manner so that it can be broken easily.

Figure 4:
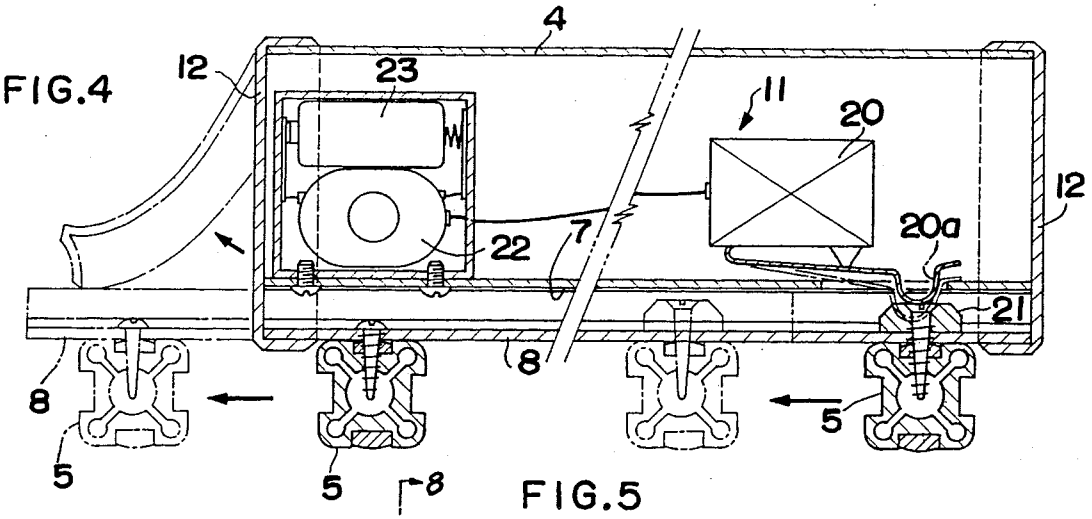
FIG. 4 is a horizontal cross-sectional view of an alarm system in the window grating.
Figure 9:
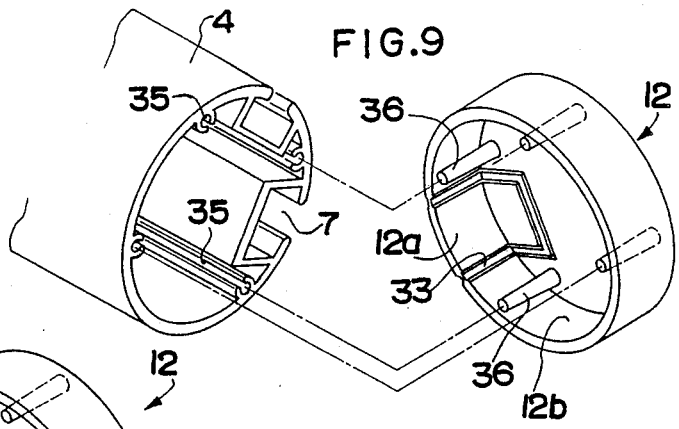
FIGS. 9–10 show two different exemplary embodiments of applied side lids of a constituent member of the window grating.
Figure 10:
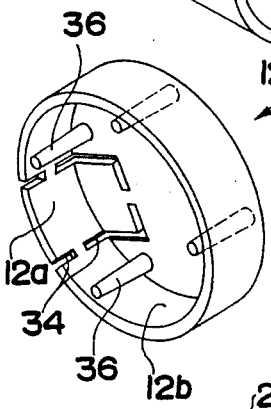

In FIG. 5 an elastic plastic side lid 12 is shown for enclosing the ends of the horizontal supports 4. As shown in FIG. 4, the side lid 12 is removed from the supports 4 by the displacement of the cross ties 8. The side lid 12 shown in FIG. 9 is provided with a thin walled portion of a linear depression 33 opposite to the guide groove 7 of the horizontal support 4, to enable the cross tie 8 to break of the corresponding portion **12*a* of the side lid 12. Furthermore, the side lid 12 shown in FIG. 10 is provided similarly with linear slots 34. Accordingly, as shown in FIG. 5, the cross ties 4 can be easily displaced without a hindrace since the corresponding portion 12*a* of the side lid 12 is broken away. As shown best in FIGS. 9 and 10, a protrusion 36 on the side of lid 12 is adapted to fit into holding holes 35 on the cross tie 4 for setting screws (not shown) formed internally on the support 4, whereby the side lid 12 can be mounted to fit easily on the end of the support 4**.

Figure 11:
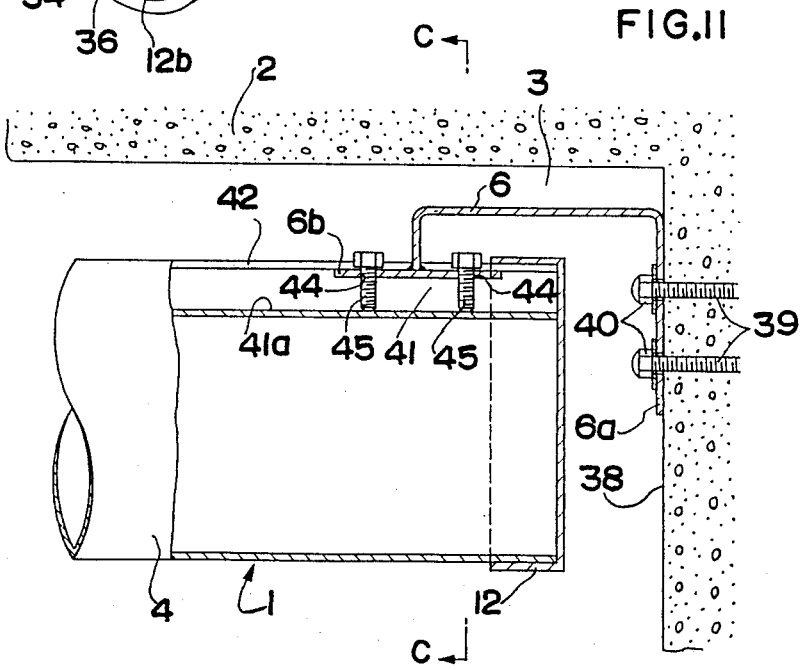
FIGS. 11–13 illustrate exemplary embodiments supporting fixtures for the frame of the window grating.
Figure 12:
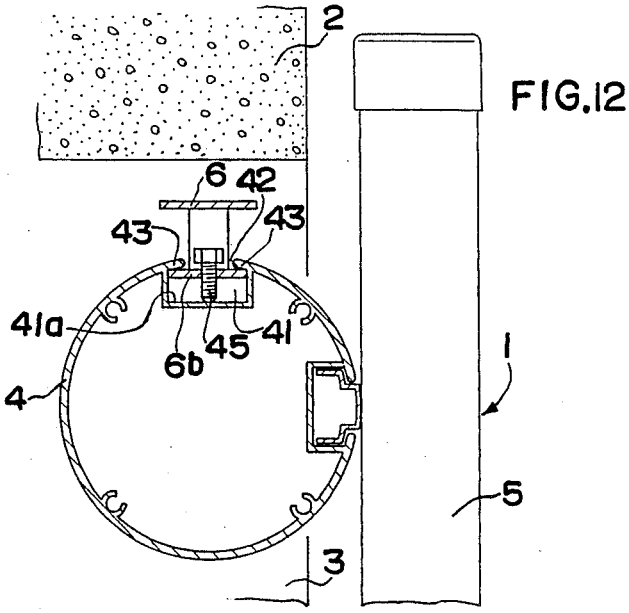
Figure 13:
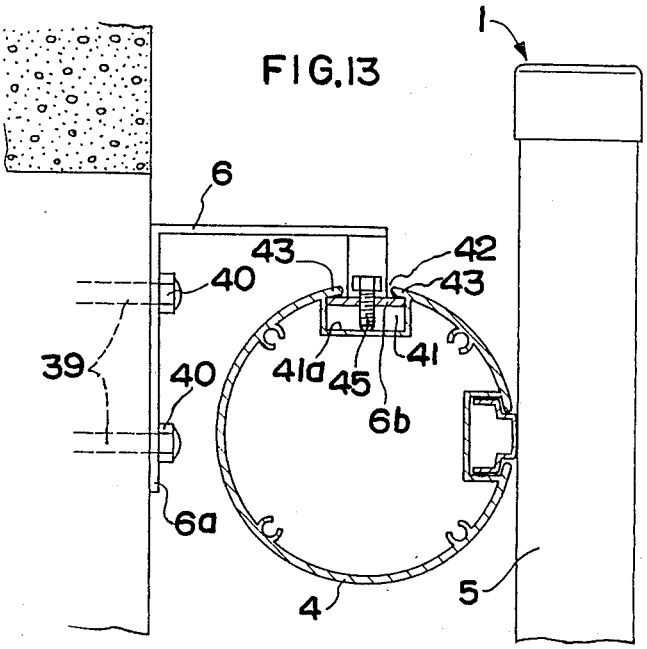
Figure 15:
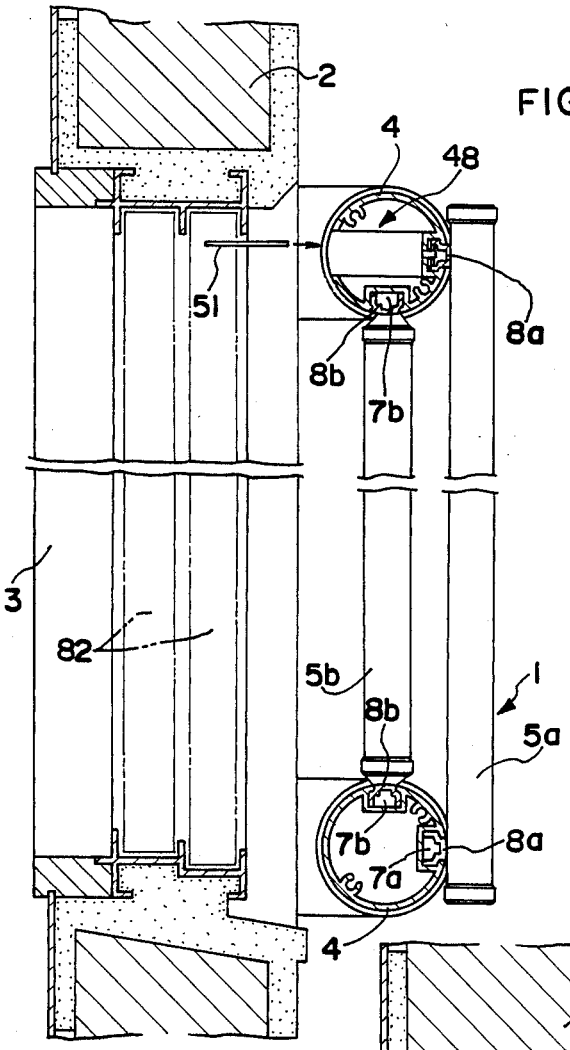
Figure 16:
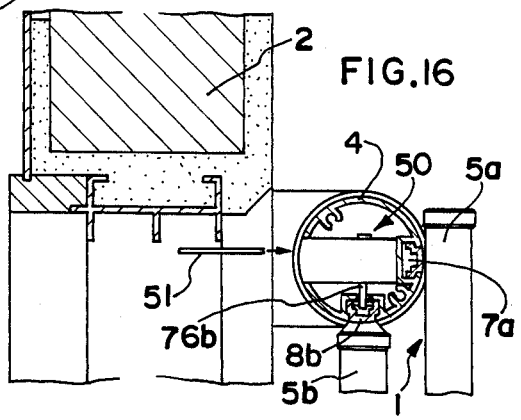
Figure 17:
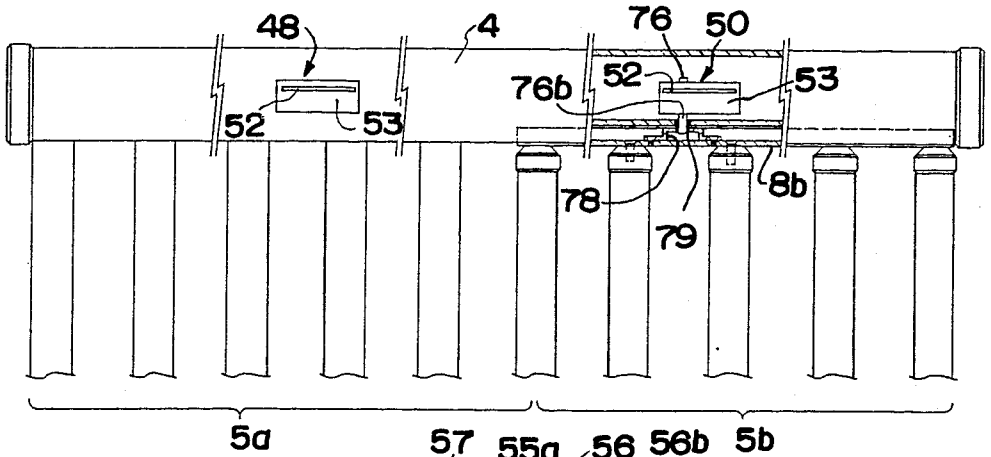

The supporting fixtures 6 are formed from a partly-shaped metal piece having a base portion **6*a* at one end and a narrow connecting portion 6*b* at the other end. In FIGS. 2, 11 and 12 the supporting fixture 6 is shown fixed on a vertical edge 38 of the wall 2 bordering on the window opening 3 by one or two anchor bolts 39 and a cap nut 40, so that the narrow connecting portion 6*b* is placed in a groove 41 in the top or bottom portion of the support 4, and then is held therein by a pair of opposed lip pieces 43 partially overlapping the groove 41. The connection to the support 4 and the fixture 6 can be performed more firmly by the use of a bolt 45 so that the bolt 45 is in contact with the bottom 41*a* of the groove 41 through a hole 44 of the narrow connecting portion 6*b*. If desired, the supporting fixture 6 can be fixed on the outside portion of the wall adjacent to the window opening, as shown in FIG. 13**.

In FIGS. 14 to 24 another embodiment of the present invention is characterized mostly in that a card type of locking device is employed, which is described below in greater detail. This locking device is operated by a special card having oblong slits that correspond to a key.

The embodiment of FIGS. 14–24 includes two kinds of mobile assemblies or groups, on outer assembly **5*a* and an inner assembly 5*b* of protective bars, of which the one assembly covers one half of the window opening and the other assembly covers another half of the opening. The outer assembly 5*a* is constructed in the same manner as the above-described single assembly 5 of the original embodiment of FIG. 1. The other, the inner assembly 5*b* is located in the inner position, i.e., on the inside, where a pair of cross ties 8*b* connect the upper and lower ends of the protective bars 5*b* that are slidably fitted into the respective downward and upward guide grooves 7*b* made in the upper and lower horizontal supports 4** respectively.

The outer assembly **5*a* of protective bars is locked immovably by means of a first card type locking device 48 including a sideways directed locking bolt 56, and the inner assembly 5*b* of protective bars is locked by a second card type locking device 50 including downwards directed locking bolt 76. Both of the card type locking devices 48, 50 are contained by the upper horizontal support 4 while each locking bolt 56, 76 is fitted respectively into insertion slots 59, 79 of striking plates 58, 78 integral with the cross ties 8*a*, 8*b* to block the lateral movement of the respective assemblies 5*a*, 5*b***.

The above-mentioned card type of locking devices are so constructed in principle that each locking bolt is forced to move back and forth, depending on the displacement of a contained mobile box having a plurality of arresting levers which can be actuated by an appropriate slotted-card.

Figure 18:
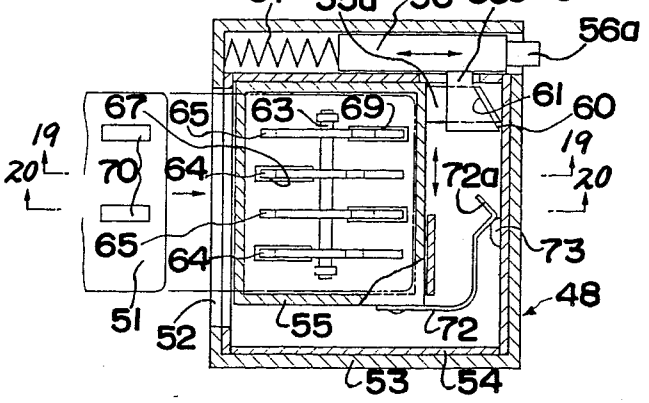
FIGS. 18–24 illustrate a card type locking device incorporated in said second embodiment of the window grating, in particular.
Figure 19:
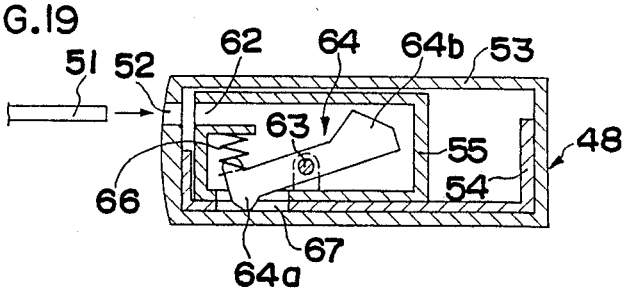
Figure 20:
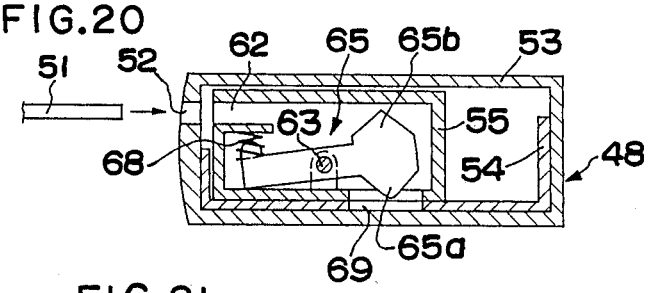

The first card type locking device 48 shown in FIGS. 18 to 24 is covered by a casing 53 which is divided into a smaller space and a larger space by an inside wall 54. The front of the casing 53 is provided with a card insertion slot 52 which communicates with the larger space, for the insertion of a card 51. The smaller space of the casing 53 contains a locking bolt 56 with a connecting end portion 56*a* and a spring 57, whereas the larger space contains a small movable slotted box 55 arranged slidably alongside the card slot 52. The movable box 55 is provided, in the portion facing to the slot 52, with a card guide 62 sufficiently wide for the width of the card 51. A plurality of arresting levers 64, 65 are arranged in the interior of the box 55. These levers are disposed parallel to each other and are swingably supported each about a supporting pin 63. The arresting levers 64, 65 are each inclined about a pin by a spring 68 so that the front side half part is lower and the rear side half part is hinger, as shown in FIGS. 19 to 23. The arresting levers 64, 65 have an angular projection extended flat at the upper and-or lower border, i.e., each arresting lever 64 of a type that is provided with an upward projection 64*b* at the upper border of the rear side half part, with a downward projection 64*a* at the lower border of the front side half part, whereas each arresting lever 65 is provided with two upward and downward projections 65*a*, 65*b* at the upper and lower borders of the rear side half part only. In relation to the downward angular projections 64*a*, 65*a* of both the arresting levers 64, 65, the bottoms of the movable slotted box and inside wall 54 laid thereunder are provided as shown in FIGS. 19 and 20, with openings 67, 69 for allowing the projections 64*a*, 65*a* to become lower into them. The downward projection 64*a* of one 64 of the levers is usually fitted into the slot 67 down to the inner surface of the casing 48 to block a lateral sliding of the movable slotted box 55.

Figure 21:
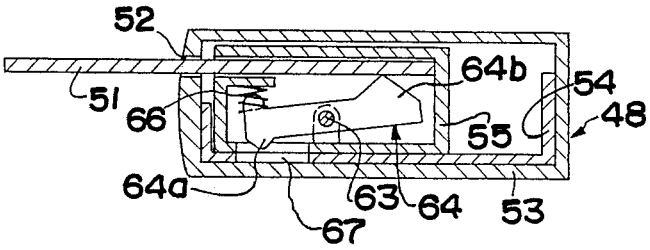
Figure 22:
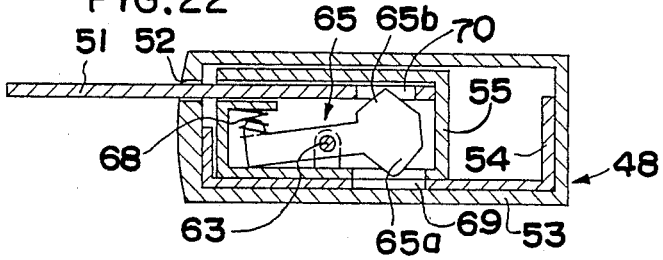
Figure 25:
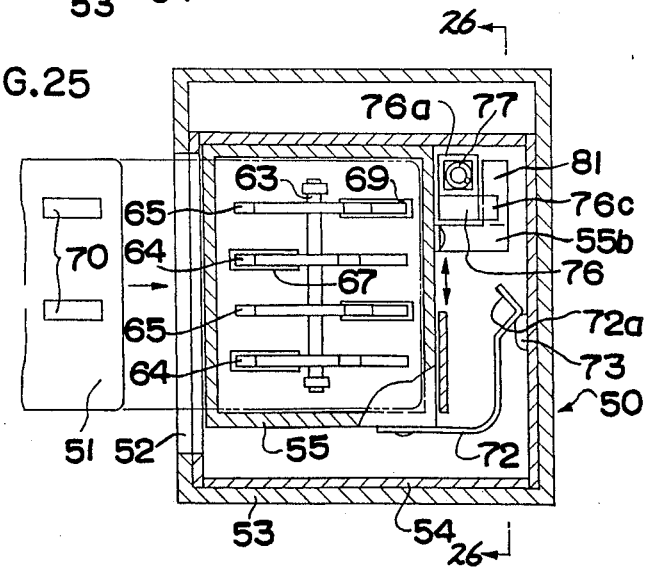
FIGS. 25 to 28 illustrate a second embodiment of a card type of locking device, in particular.
Figure 26:
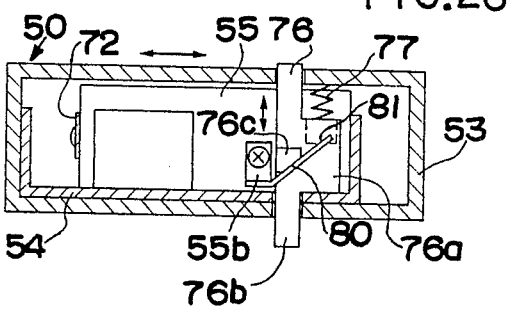
Figure 27:
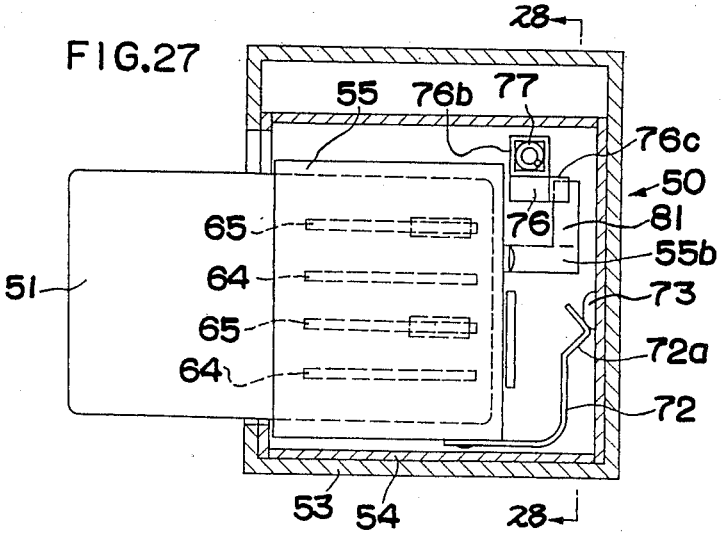
Figure 28:
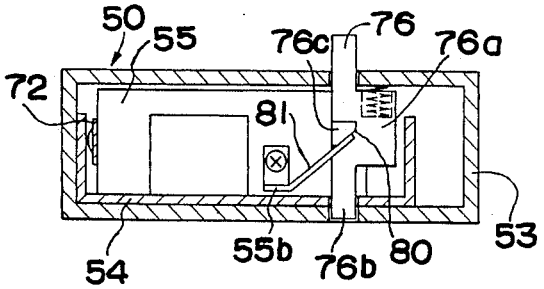

In operation of the movable slotted box 55, when a correct card 51 having slots 70 formed in one or more proper positions is inserted through the card entrance slot 52 of the casing 53 into the movable slotted box 55, one of the arresting levers 64 is turned to a nearly horizontal position, as shown in FIG. 21, by the contact of the solid surface of the inserted card 51 with the upward projection 64*b* of the lever 64, so that the downward projection 64*a* of the lever 64 is lifted out of the inner surface of the casing 48 to enable the movable box 55 to slide laterally within the casing 48. The other arresting lever 65 is kept in the former position, as shown in FIGS. 20 and 22, with the upward projection 65 fitted into the hollow slit 70 of the inserted card 51, to enable the movable box 55 to slide in the casing in cooperation with the arresting lever 64. After inserting the proper slotted card 51 in the movable slotted box 48, the card 51 is manually displaceable laterally in the casing 50 together with the movable box 48, as shown in FIGS. 25 and 27.

Figure 23:
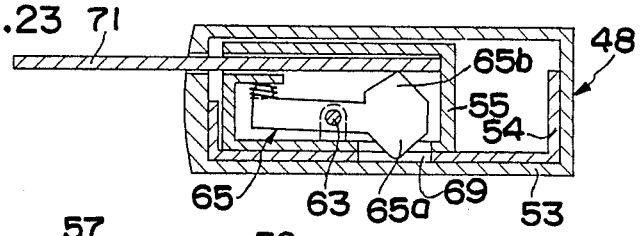

If an improper card 71 is inserted in the box 55 as is shown in FIG. 23, on of the arresting levers is turned to a nearly horizontal direction, so that the downward projection 65*a* fits into the slot 69 down to the inner surface of the casing 48 to block a lateral sliding of the movable box 55. Thus, only a correct card 71 can unfasten the movable box 55.

Figure 24:
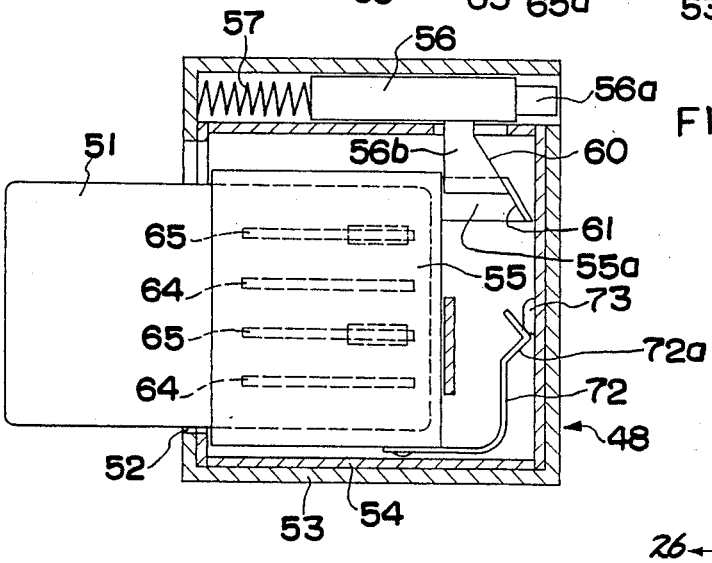

The movable box 55 and locking bolt 56 are connected with on another, as shown in FIG. 18, by driving projection 55*a* and a following projection 56*b* of which both are fixed on the respective members and have a cam face 61, 60 brought into oblique contact with one another to cause the locking bolt 56 to move back and forth by the lateral displacement of the movable box 55. Thus, the movable box 55 is caused to slide lateral in the larger space of the casing 48 by the card 51, so that the locking bolt 56 moves back and forth in the smaller space of the casing while the connecting end portion 56*a* of the locking bolt 56 is fitted into ao taken out of the insertion slot 59 to connect or disconnect the cross ties 8*a* with the support 4. In FIGS. 18 and 24 is locating plate spring 72 is attached on one of its sides to the movable box 55. A protrusion 73 on the inner wall is adapted to contact the part 72*a* of the spring 72.

A second embodiment of card type locking device 50, in contrast to the first embodiment above, is shown in FIGS. 25–28. This embodiment is so constructed to move a locking bolt 76 vertically in the inside of the casing 53 so that its lower end portion 76*a* is pushed downwardly from the hole of the casing 53 by a spring 77. The locking bolt 76 is provided at one side with a projection 76*c* having a downward sloped cam following face 80, which is supported engagedly by a sloped driving cam face 81 of an extension piece 55*b*, attached at its other end in the rear side of the movable box 55. As a result, the locking bolt 76 is displaced up and down by the movement of the movable box 55. Accordingly, the lower end portion 76*b* is pushed outwardly by or is drawn inwardly to effect the connection or disconnection of the locking bolt 76 with the support 4.

The above-described embodiments are so arranged that the supports 4 of stationary members are mounted on the upper and lower borders of the window opening 3 while the movable assemblies 5, or 5*a*, 5*b* are maintained in a sideways movable manner, but it is possible to employ such an arrangement that the supports are mounted on the lateral borders of the window opening while the movable assemblies are maintained in a vertically movable manner.

What is claimed is:

1. A window grating arrangement comprising at least two enlogated, horizontal stationary supports disposed parallel relative to one another and being attached to upper and lower edges of a window opening in the wall of a buiding, an elongated groove formed in each of said supports substantially along the length thereof, a mobile assembly comprised of a protective grating having protective bars, and of at least two cross ties disposed parallel relative to one another and uniting the protective bars into said protective grating, a cross tie each being slidably disposed within an elongated groove, whereby the protective grating selectively covers the window opening and is slidable away from such covering to enable egress through said opening.

2. The window grating arrangement of claim 1, further comprising a protective lid each disposed over each end of a stationary support, each lid being adapted to break away upon being impacted upon by a cross tie.

3. The window grating arrangement of claim 1, further comprising a locking device for selectively preventing displacement of the protective arrangement from covering the window opening.

4. A window grating arrangement as defined in claim 3, wherein the locking device comprises a locking bolt for engaging with the mobile assembly of protective bars, a spring arranged for pushing the locking bolt out of the support, and a forcibly breakable plastic lid for keeping the locking bolt in the inside of the support.

5. A window grating arrangement as defined in claim 3, wherein the locking device is of a card type adapted to operate with a correct slotted card, comprising a locking bolt for engaging with the mobile assembly of protective bars, a movable slotted-box which contains one or more inclinable arresting levers and is caused to move by a correct slotter-card capable of adjusting desired inclinations of the levers, and the locking bolt and slotted-box having each extention provided with a driving cam face and a following cam face respectively for transmitting movement of the slotted-box to the locking bolt so as to move back and forth the locking bolt.

6. The window grating arrangement of claim 3, further comprising an alarm system for sensing the condition when said grating is slid away from covering said window opening, and for emitting an alarm signal upon such sensing.

* * * * *